US005834710A

United States Patent [19]

Finnestad

[11] Patent Number: 5,834,710

[45] Date of Patent: Nov. 10, 1998

[54] ACOUSTIC PULSE GUN ASSEMBLY

[75] Inventor: Scott J. Finnestad, Red Deer, Canada

[73] Assignee: Otatco Inc., Calgary, Canada

[21] Appl. No.: 662,770

[22] Filed: Jun. 10, 1996

Related U.S. Application Data

[63] Continuation-in-part of Ser. No. 625,736, Mar. 29, 1996, abandoned.

[51] Int. Cl.[6] ..... G01V 1/40

[52] U.S. Cl. ..... 181/106; 181/102; 181/119; 367/86; 367/87; 367/99; 367/908

[58] Field of Search ..... 181/106, 102, 181/119; 367/86, 87, 99, 911, 908

[56] References Cited

U.S. PATENT DOCUMENTS

| | | | |
|---|---|---|---|
| 3,316,997 | 5/1967 | McCoy | 181/5 |
| 3,915,256 | 10/1975 | McCoy | 181/102 |
| 4,408,676 | 10/1983 | McCoy | 181/113 |
| 4,637,463 | 1/1987 | McCoy | 166/250 |
| 4,646,871 | 3/1987 | Wolf | 181/106 |
| 4,934,186 | 6/1990 | McCoy | 73/151 |
| 5,117,399 | 5/1992 | McCoy et al. | 367/99 |
| 5,165,383 | 11/1992 | Ebert et al. | 124/74 |

OTHER PUBLICATIONS

Echometer Company—Ad. Brochure—about 1975–1980 (a) Model D; (b) Single Shot Gas Gun; (c) Implosion Gas Gun.

Instruction sheet from Crossman re "New Improved piercing System", date unknown, page No. unknown.

*Primary Examiner*—J. Woodrow Eldred

[57] ABSTRACT

A gas gun is provided for generation of an acoustic pulse and subsequent detection of return reflections from the annulus of a well. The system includes a gas gun and a hand-held gas source. The hand-held gas source comprises: a two-part housing forming a chamber for receipt of a small $CO_2$ gas cartridge commonly used for $CO_2$ target pistols; means for piercing the gas cartridge and pressurizing the chamber; a coupling for releasable connection to a delivery assembly; a passageway leading from the chamber to the coupling; and a first valve in the passageway for controlling release of gas from the chamber. The gas gun comprises: a housing forming a chamber having inlet and outlet ports; a connection from the outlet port to the wellhead; a coupling on the inlet port for releasable and sealable connection to the gas source; a second valve for closing the inlet port; a pilot operated, pressure differential assisted solenoid valve on the outlet port for suddenly releasing pressurized gas from the chamber and into the wellhead; and a microphone communicating with the outlet port for receiving acoustic reflections. Preferably the housing of the gas gun permits the solenoid valve to be reversibly installable, enabling rapid release of gas either into or out of the wellhead.

9 Claims, 10 Drawing Sheets

ACOUSTIC PULSE GUN ASSEMBLY

CROSS-REFERENCE TO RELATED APPLICATION

This application is a continuation-in-part of application Ser. No. 08/625,736 filed on Mar. 29, 1996, now abandoned.

FIELD OF THE INVENTION

The present invention relates generally to gas gun apparatus for abruptly altering the pressure of the gas in the annulus of a wellbore for acoustic pulse testing, and more particularly, to a $CO_2$ cartridge powered gas source and a pilot-operated solenoid actuated gas release means.

BACKGROUND OF THE INVENTION

The level of fluid in the borehole of a well is an important element in the field of oil well testing and operation. In most instances, a well owner occasionally wants to know the liquid level in the well as a guide to optimizing production. In other instances, during pressure build-up testing, it is useful to collect data with respect to dynamic fluid levels in the borehole over time; collecting data frequently at the early stages of the test and then less and less frequently as the test progresses.

Determination of the liquid level in a well by acoustic pulse has been successfully performed for many years. U.S. Pat. No. 2,232,476 issued to Ritzmann in 1941, discloses the basic methodology wherein a high frequency acoustic pulse is projected down the annulus between the tubing string and the well casing string. Reflections are generated by cross-sectional variations along the length of the tubing string, such as are created by tubing collars or the surface of the liquid column in the annulus.

Various schemes for computer aided interpretation of the reflection results are taught by U.S. Pat. No. 4,318,298, issued to Godbey, U.S. Pat. No. 4,793,178, issued to Ahern and U.S. Pat. No. 5,200,894, issued to McCoy.

A necessary component of the acoustic pulse system is the means for generating the acoustic pulse. This assembly is generally referred to as a gun. In some cases it involves the discharge of a blank 45 calibre or shot-gun shell cartridge. This form of gun is typified by the "Quick Load" or "10-Gauge" gun-microphone assemblies available from the Echometer Company, Wichita Falls, Tex. Although usually the wellbore is free of oxygen, unusual vacuum conditions and well servicing can result in an oxygenated atmosphere in the well annulus and the possibility of explosion when the shell is discharged. Accidents and the ever increasing emphasis on safety have significantly reduced use of these assemblies.

In other instances a gas-powered gun is used to generate a sharp release of pressurized gas into the wellbore. Still in wide-spread use is the provision of a tubular coupling connecting a gas chamber to the wellhead. The chamber is pressurized to the desired energy level from a pressurized gas storage bottle and restrained from release into the wellbore by a hand operated ball valve. A microphone connects through the wall of the tubular coupling, so as to access the wellbore.

The difficulties associated with such gas gun assemblies are two-fold: the handling is inconvenient; and the pressurized gas storage bottles are inherently dangerous and accordingly the transport of these bottles is subject to transportation restrictions.

In other instances, the pressure in the wellhead may be too high to effectively generate an acoustic pulse. Consequently, the above gun may be applied in a reverse manner; the chamber being maintained at substantially atmospheric pressure. When the ball valve is suddenly opened, high pressure gas at the wellhead is permitted to enter the chamber, creating the acoustic pulse.

A difficulty common to both methods of forming an acoustic pulse, be it either into or out of the wellhead, is the speed of the opening of the ball valve. If the speed is too slow, say spanning a duration equal to or greater than the acoustic timing between the particular annulus features sought, the quality of the acoustic pulse suffers and interferes with the acoustic reflection information.

More advanced gas guns, providing additional safety features and quicker release of gas, are mechanically complex. One such a gun is disclosed in U.S. Pat. No. 4,408,676, issued to McCoy. The gun depends heavily upon O-ring sealing arrangements which are prone to early failure, for example:

- when warm, they tend to blow free of their seats during the pulse;
- when cold, they tend to fracture; and
- when attached to the wellhead, the O-rings are subject to contact with the produced oil, become contaminated with solids and tend to swell.

In accordance with the invention, a rapid-opening gas gun is provided which does not utilize O-rings for parts in contact with the environment, uses a minimum of parts, and provides a convenient means for charging the gas gun. The gun is hand held and not subject to transport or carrying restrictions.

SUMMARY OF THE INVENTION

In one aspect of the invention, a hand-held gas source is provided, comprising:

- a two-part housing assembly comprising first and second axially aligned parts;
- the parts combining to form a substantially cylindrical chamber for reception of a disposable cylindrical pressurized $CO_2$ cartridge, preferably a conventional disposable air gun power cartridge;
- telescoping means for physically connecting the two housing parts and sealing therebetween, preferably consisting of a threaded connection;
- the first housing part having a closed end for advancing the cartridge into the chamber portion formed by the second housing part;
- means, positioned in the chamber of the second housing part, for piercing the cartridge, preferably, the threaded connection and piercing means cooperating so that contraction of the length of the chamber first seals the two parts and then brings the cartridge into engagement with the piercing means, piercing the cartridge and releasing pressurized $CO_2$ gas into the chamber;
- outlet port means at one end of the housing assembly, remote from the first housing part, for discharging gas from the chamber; and
- valve means positioned in the outlet port means for controlling the release of pressurized $CO_2$ from the chamber.

In another aspect, an improved gas gun is provided which utilizes a pilot-operated solenoid valve to permit rapid and automatic actuation of the gas gun, despite pressure differentials across the solenoid valve.

In combination, the two aspects described above, can be combined, resulting in a gas gun system incorporating the convenience of a hand-held gas source, devoid of shipping restriction and hazard, coupled with the rapid discharge, automatic pilot-operated solenoid valve triggered gas gun.

In yet another aspect, the pilot-operated valve, which uses pressure differential to operate and is necessarily unidirectional, is reversibly installable in the gas gun to permit rapid release of high pressure gas either into or out of the wellhead.

BRIEF DESCRIPTION OF THE DRAWINGS

FIG. 12*a* is an exploded perspective view of the gas gun of FIG. 9, with the solenoid valve oriented for installation so as to facilitate release of gas into the wellhead;

FIG. 12*b* is an exploded perspective view of the gas gun of FIG. 9, with the solenoid valve oriented for installation so as to facilitate release of gas out of the wellhead; and FIG. 12*c* is an assembled perspective view of the gas gun of FIG. 9, with the pin and L-shaped slot connection engaged.

DETAILED DESCRIPTION OF THE PREFERRED EMBODIMENT

Figure 2:
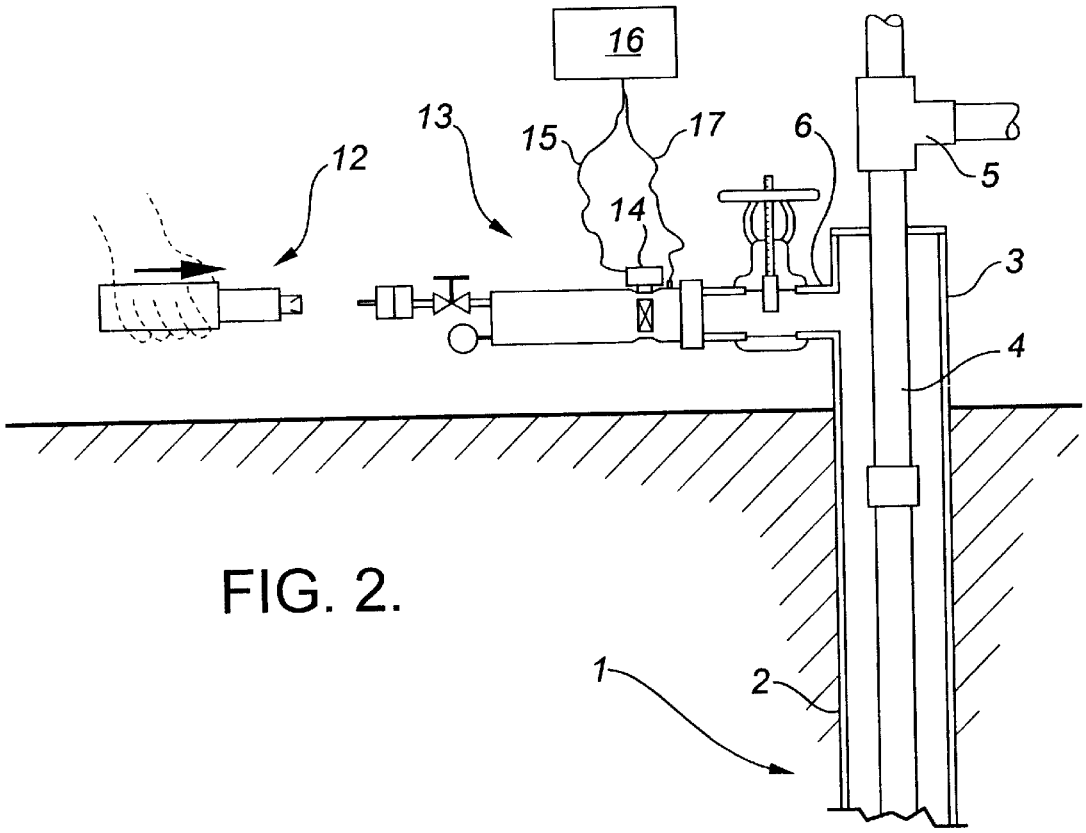
FIG. 2 is an illustration of a service technician preparing to charge an embodiment of the present invention by applying the hand-held gas source supply to the gas gun.

Having reference to FIG. 2, a well 1 is shown comprising a well casing string 2, wellhead 3, tubing string 4 and a flow tee 5 for carrying off any produced fluids. The wellhead has a threaded opening 6, suitable for the connection of acoustic pulse testing equipment.

Figure 1:
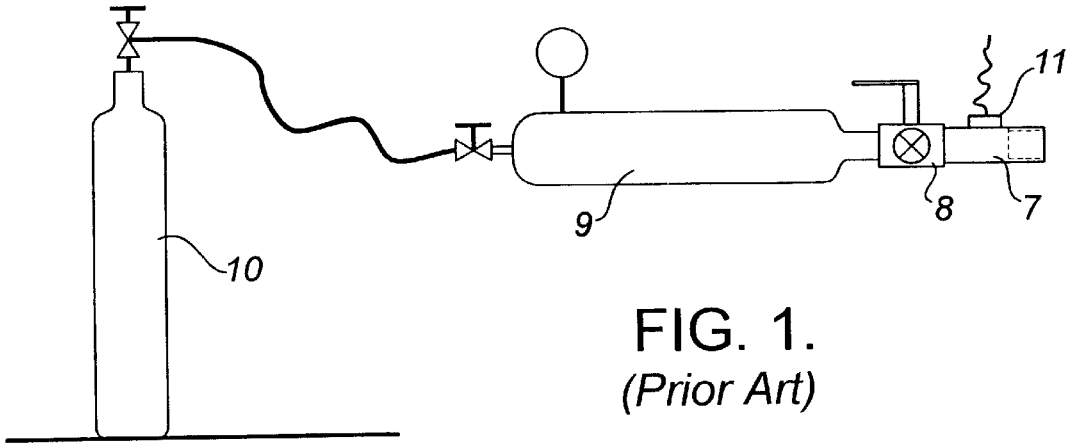
FIG. 1. (Prior Art)
FIG. 1 is an illustration of the prior art gas gun.

As shown in FIG. 1, conventional acoustic pulse testing equipment comprises a tubular member 7 for connection to the wellhead 3, ball valve 8, pressure chamber housing 9 and gas source 10. Microphone 11 is connected with member 7, for recording acoustic reflections from the well.

Briefly, as shown in FIG. 2, the present invention comprises a stainless-steel hand-held gas source 12 and a stainless-steel gas gun 13. The gas gun 13 utilizes a solenoid valve 14 which has an electrical lead 15 which is energized by control means 16. Lead 17 directs an electrical signal from the microphone to the control means 16.

Figure 3:
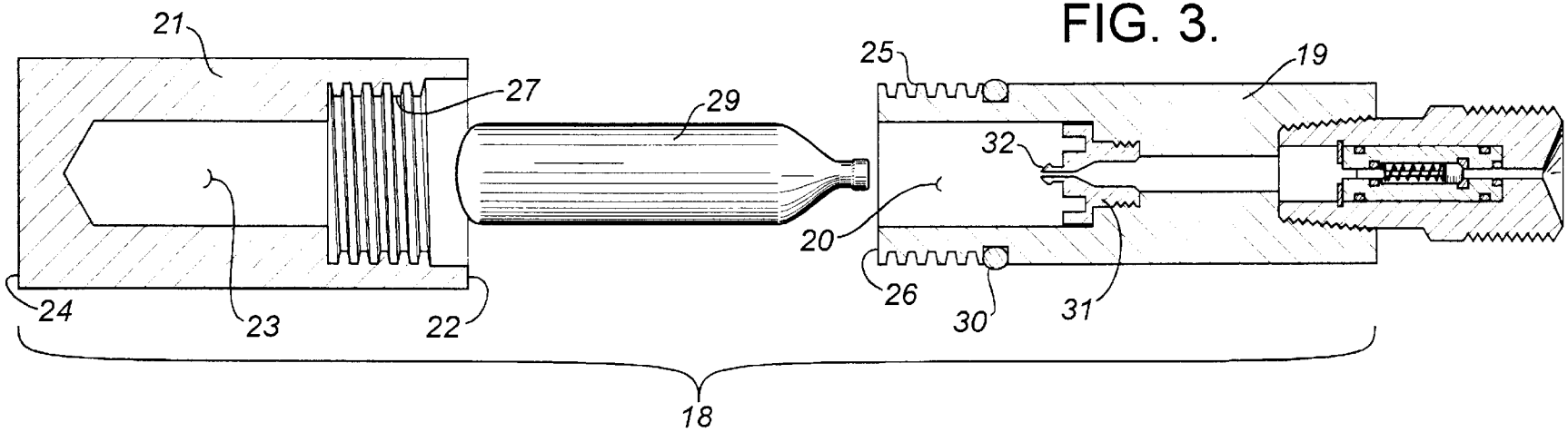
FIG. 3 is an exploded cross-sectional view of an embodiment of the hand-held gas source.

More specifically, having reference to FIG. 3, the hand-held gas source 12 comprises a cylindrical two-part housing 18 consisting of a main body portion 19 having a concentric bore 20 extending therethrough, and a cap portion 21 having an open end 22 forming a bore 23 and a closed end 24. The main body portion 19 has an externally threaded front end 25 at its first end 26 for telescoping threaded engagement with an internal threaded portion 27 of the cap 21. When threaded together, the main body portion 19 and the cap 21 form chamber 28.

The chamber 28 is sized to accept a conventional disposable $CO_2$ cartridge 29, such as a Crossman small neck "Powerlet" (registered trademark) manufactured by Crossman Air Guns and available for any sporting goods store. The cartridges are commonly used for powering target pistols. The cartridge is about 3¼ inches long and ¾ inches in diameter and contains 12 grams of $CO_2$ liquid at 900 psi, producing approximately 400 cubic inches of $CO_2$ gas at standard conditions. After inserting the cartridge 29 into the bore of the cap 21, the cap is threaded onto the body 19. O-ring 30 engages the end 27 of the cap, effectively sealing the chamber 28.

The bore 20 of the main body 19 contains a piercing element 31 threaded into the bore 20. The element 31 has a sharp, tubular piercing end 32.

Figure 4:
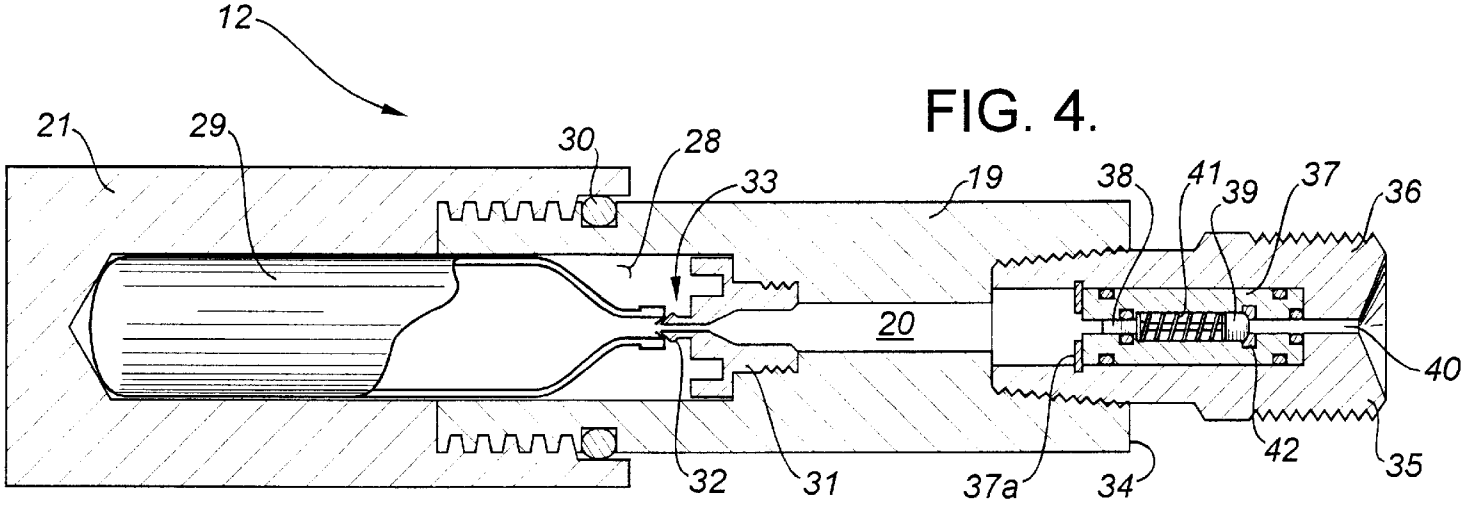
FIG. 4 is a cross sectional view of the assembled gas source of FIG. 3, with the $CO_2$ gas cartridge pierced and the gas source pressurized.

As shown in FIG. 4, the length of the chamber 28 is such that, after the O-ring seals the chamber 28, any further threading of the cap 21 into the body 19 causes the cartridge 29 to be driven onto the sharp piercing end 32 of the element 31. As the piercing element is tubular, $CO_2$ contained within the cartridge is released through the element 31. Side port 33 in the piercing end 32 releases $CO_2$ into the chamber 28.

The bore 20 of the main body 19 is sealed at its second end 34 by a valve 35. Valve 35 acts normally to seal the bore 20 and retain pressure within. The valve 35 comprises a body 36, threaded into the main body 19. A valve sub-assembly 37 is retained within the valve body 36 by snap-ring 37*a*. The valve sub-assembly 37 comprises a poppet 38, having a poppet head 39, which reside within passageway 40 which acts as an extension of bore 20. Spring 41 urges the poppet head 39 against seal 42, sealing the passageway 40 and thus also sealing the bore 20. Valve sub-assembly 37 is the "Plug" portion of a "Plug and Probe" valve assembly available from Taylor Tools, Inc., Oklahoma City, Okla., model number GP-SH-1 for the Plug and GPR-LS-2 for the Probe. This valve assembly is a 316 stainless steel model, capable of retaining 20,000 psi pressure.

Figure 5:
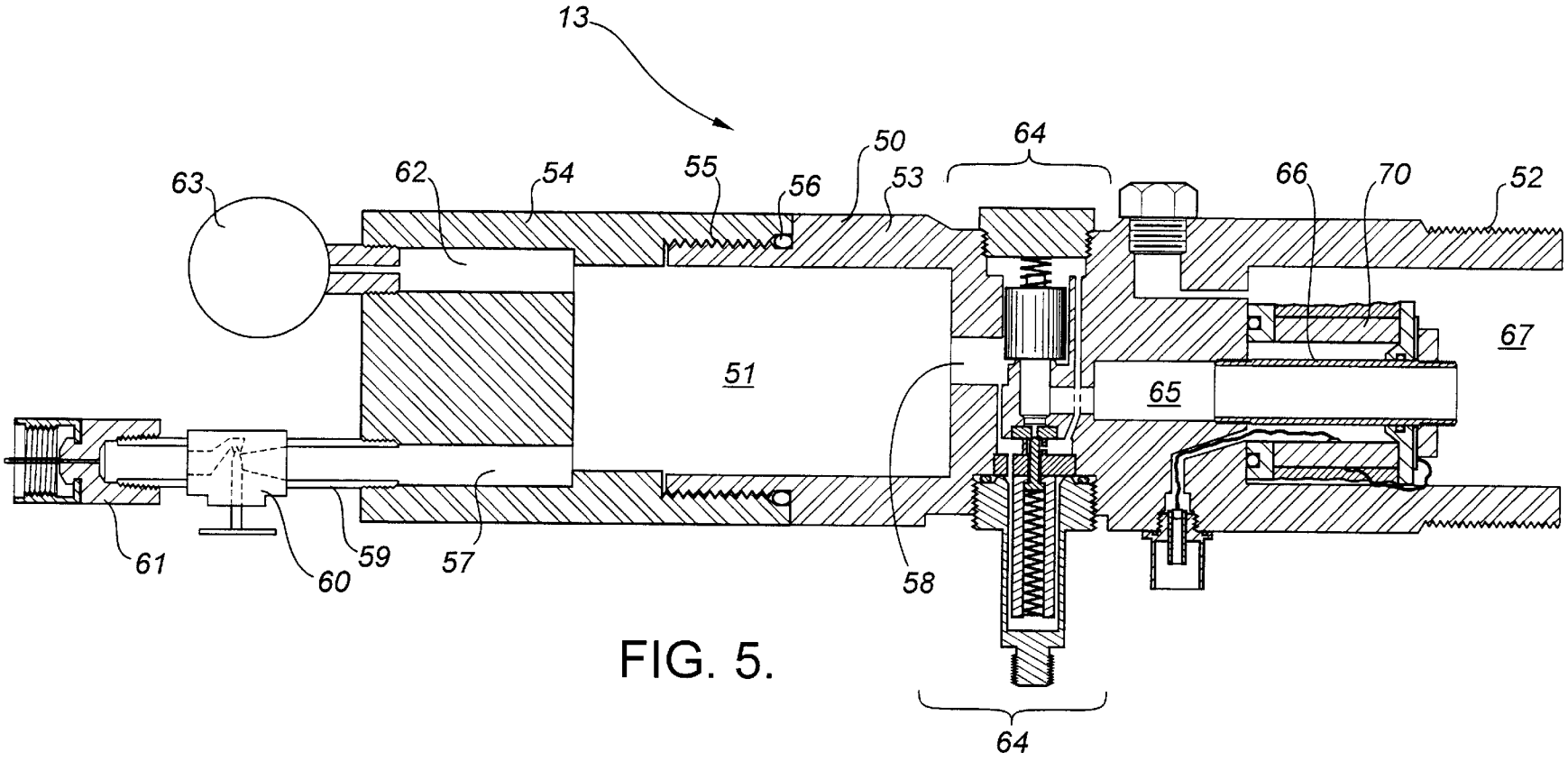
FIG. 5 is a cross sectional view of an embodiment of the gas gun of the present invention.

Having reference to FIG. 5, one embodiment of the gas gun 13 comprises a housing 50 forming an internal chamber 51 and having a bore 67 at its open outlet end 52. The housing 50 is operative to connect to the threaded opening 6 of the wellhead 3. The housing 50 is assembled from two tubular parts; a first part 53 and a second part 54, each part having a complementary threaded end for mating together at connection 55. An O-ring 56 seals the two housing parts 53, 54 together and seals the chamber 51. The chamber 51 forms an inlet port 57 and outlet port 58 at its ends. The inlet port 57 is connected by conduit 59 to valve 60. The valve 60 is connected to the "Probe" portion 61 of a Plug and Probe valve assembly. A third port 62 connects the chamber 51 to a pressure gauge 63.

Figure 6A:
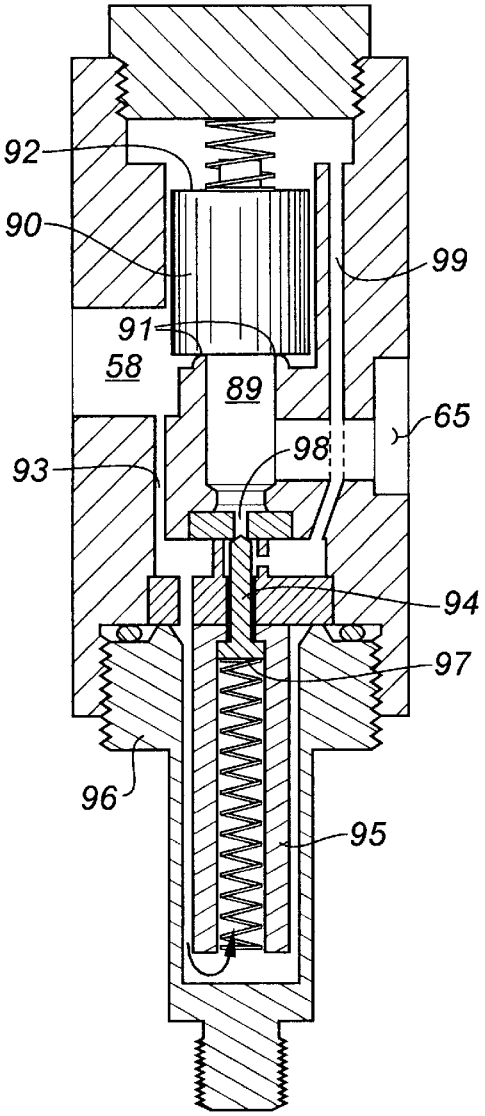
FIG. 6*a* and 6*b* are cross-sectional views of the pilot-operated solenoid valve portion of the gas gun in a closed and open condition respectively.
Figure 6B:
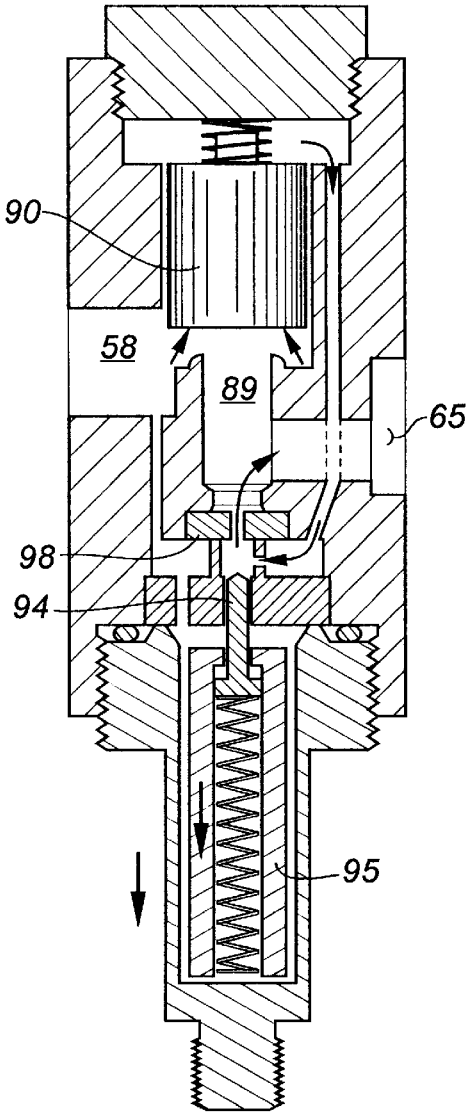

The outlet port 58 provides an inlet passageway to a solenoid valve 64, available from Honeywell Inc., New Britain, Conn., under the designation 73216, 2-way, N.C. ¼" NPT. This solenoid valve is shown in FIGS. 6*a* and 6*b*. For clarity, the actuating coil for the solenoid valve is not shown. As shown, the solenoid valve 64 is incorporated into the housing 50. The solenoid valve 64 communicates with an output passageway 65 leading to conduit 66 which is positioned within the bore 67 of the open end 52 of the housing 50.

Figure 7:
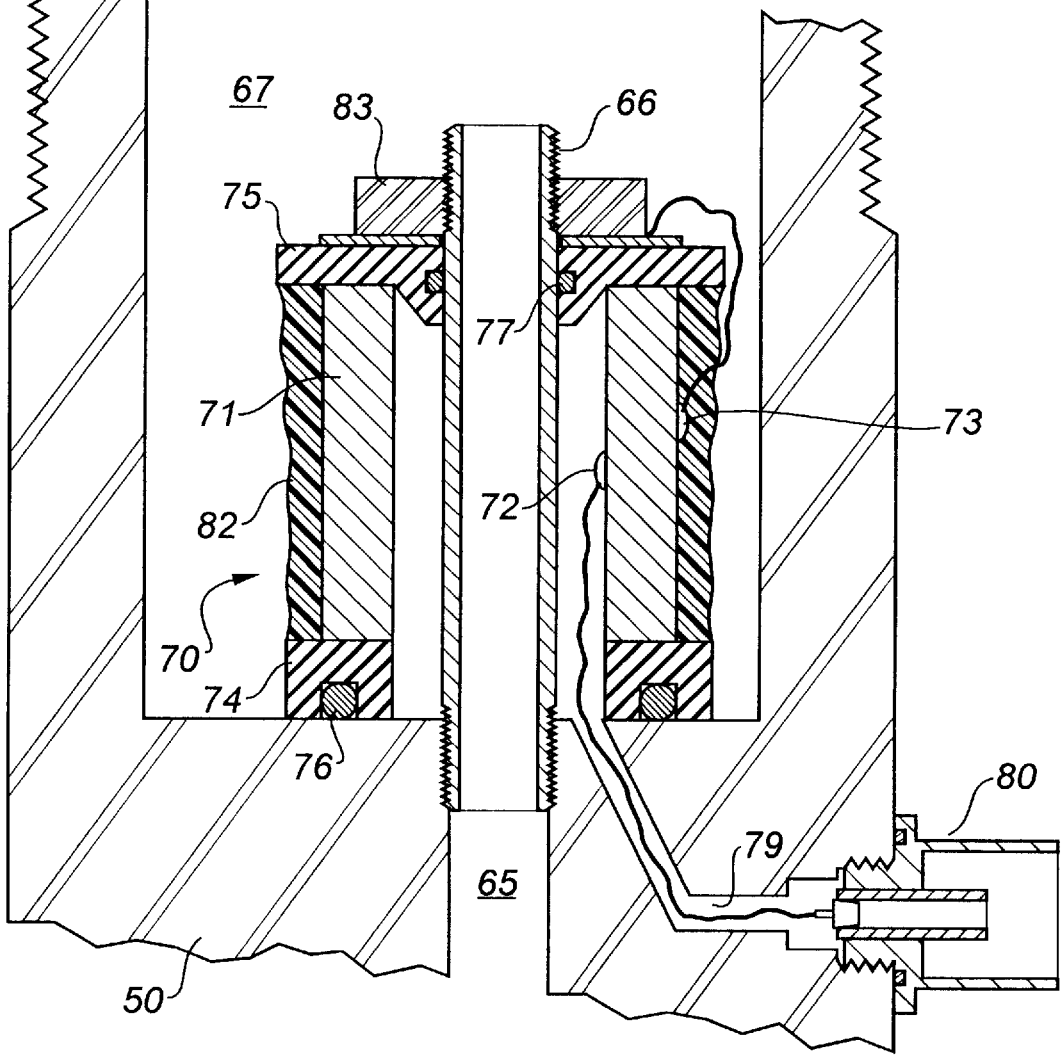
FIG. 7 is a partial, cross-sectional view of the wellhead connection end of the delivery assembly, in particular, showing the microphone assembly.

A microphone 70 is disposed around conduit 66. Having reference to FIG. 7, the microphone is shown to comprise a 1" diameter, 1" high thin-wall hollow cylindrical piezoelectric crystal 71, available as a Lead Zirconate Titanate ceramic crystal from Channel Industries, Inc. Santa Barbara, Calif. The crystal is silver coated for the connection of one electrode 72 on the inner cylindrical surface and one electrode 73 on the outer surface.

The crystal 71 is sandwiched between two non-conductive acetal plastic washers 74,75, available under the trademark Delrin, from Dupont. An O-ring 76 between the first washer 74 and the housing 50 and an O-ring 77 between the second washer 75 and conduit 66 seal the bore 67 from the bore 78 of the crystal 71. The crystal is encapsulated in a protective polyester resin layer 82. The two part material comprises an unsaturated polyester resin in a styrene monomer, with a strong organic peroxide hardener. This material is available as product 42-078 from Progress Plastics & Compounds Inc, Mississauga, Ontario.

The microphone assembly 71 is secured to the housing 50 by a nut and washer 83, threaded onto conduit 66. Electrical lead 72 is directed through passageway 79 to a BNC signal connector 80. Something less than an absolute seal at the BNC connector results in substantially atmospheric pressure within the bore of the microphone. This enhances its response to reflections impinging its exterior. Lead 73 is grounded to conduit 66, thus ultimately to the housing and the wellhead.

Figure 8A:
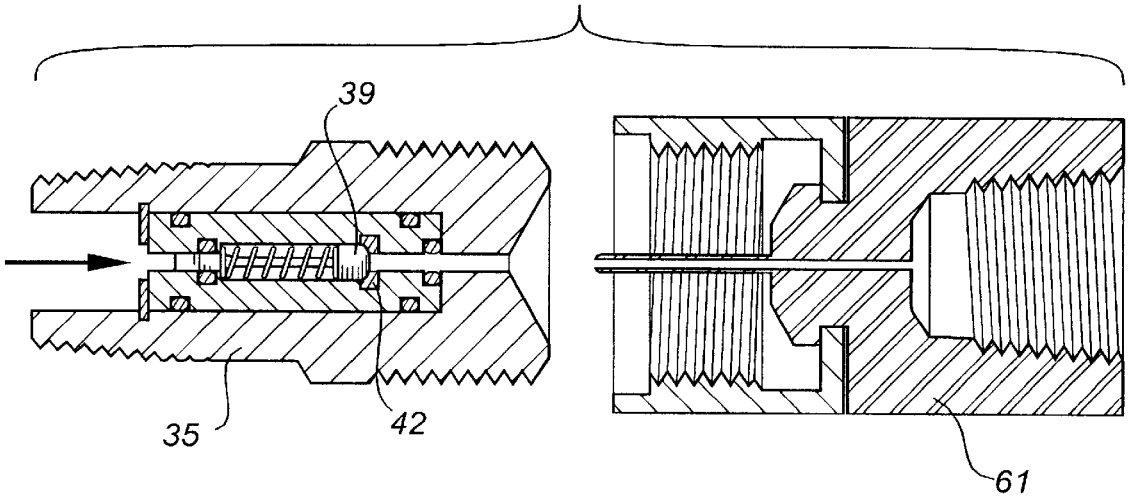
FIG. 8*a* and 8*b* are cross-sectional views of the "Plug" and "Probe" valve, in disconnected and connected positions respectively, used for quick connection of the hand-held gas source and the gas gun.
Figure 8B:
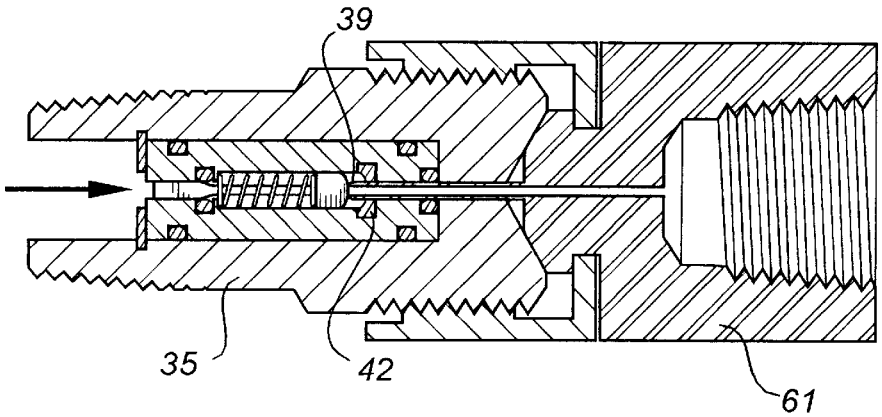

Having reference to FIGS. 4, 5, 8*a* and 8*b*, the system operates as follows. The operator unscrews the two parts 19,21 of the hand-held gas source 12 and inserts a $CO_2$ cartridge 29. The two-part housing is threaded together, puncturing the cartridge 29 on the piercing element 31, and filling the chamber 28 with pressurized gas. Valve 35 retains the pressure within the hand-held source. As shown in FIG. 8*b*, the "Plug" end valve 35 of the source 12 is connected with the "Probe" end 61 of the gas gun 13. Valve 35 is forced open and valve 60 is opened, charging chamber 51. The valve 60 is then closed. The gun is pressurized and ready for use.

The solenoid 64 is then actuated by the control means 16 through lead 15, signalling for release of gas from chamber 51 into the wellhead 3. The solenoid valve 64 is pilot-operated, which is particularly suitable for operation under high pressure differentials. In order to obtain fast, low electrical power actuation of a high pressure differential valve, pressure balancing assistance is required.

More particularly, referring to FIGS. 5 and 6*a*, when the solenoid coil (not shown) is not energized, then the inlet and outlet passageways 58, 65 are not open. Piston 90 is seated against seat 91 to block main orifice 89. The piston 90 is well seated due to the greater available surface area for pressure to act on its upper surface 92, which exceeds the area available from below. The piston 90 is formed of an acetal plastic as described for the microphone washers above. This ensures a good seal between piston and seat. Bleed passageway 93 directs high pressure gas to a pilot needle 94, housed within an armature 95. The armature 95 is shrouded in a housing 96. Pressure on the outwards end 97 of the pilot 94 exceeds the pressure acting through and around the pilot orifice 98 the pilot 94 is seated on, thus securely maintaining the orifice 98 in a closed condition.

When the solenoid actuator is energized, the armature 95 retracts, pulling the pilot needle 94 with it, opening the orifice 98. Low pressure from the outlet passageway 65 quickly bleeds off excess high pressure from the backside of the piston through passageway 99, and the now higher pressure on the underside of the piston 90, from inlet passageway 58, causes it to quickly snap open, enabling flow through the main orifice 89.

There are no moving O-rings in the valve 64 or the gas gun as a whole, and no O-rings which contact the process fluids.

The rush of gas exiting through the centre of the conduit 66 does not impinge on the microphone 70 and thereby avoids overstressing it.

Figure 9:
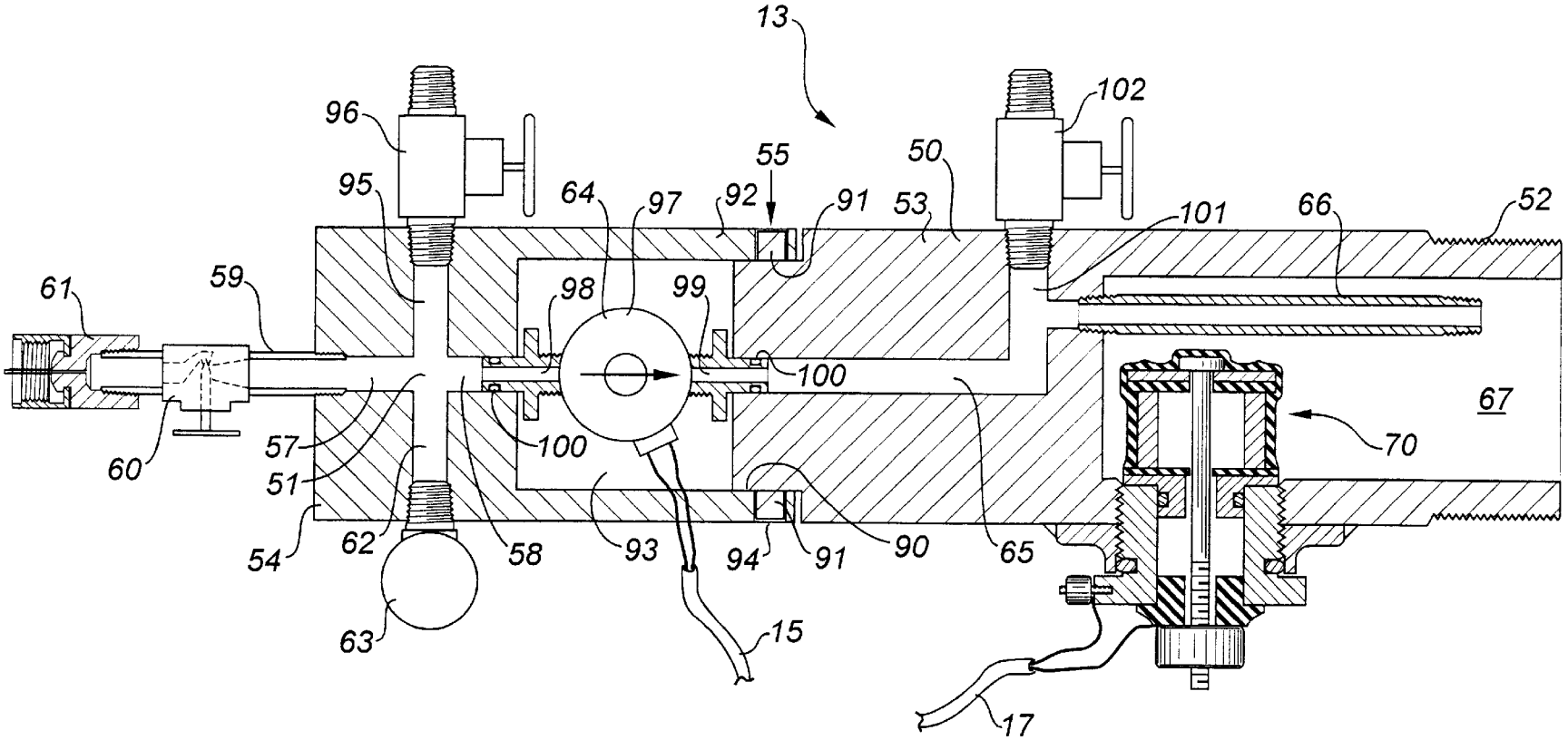
FIG. 9 is a cross sectional view of another embodiment of the gas gun of the present invention.

Having reference to FIG. 9, a second embodiment of the gas gun 13 is presented. Several aspects of the first and second embodiments are the same and are accordingly assigned the same reference numerals.

The second embodiment of the gas gun 13 comprises a housing 50, having an internal chamber 51 and having bore 67 at its open outlet end 52. The housing 50 is operative to connect to the threaded opening 6 of the wellhead 3. The housing is assembled from two parts; a first part 53 and a second part 54, each part having a complementary end for mating together at connection 55. First part 53 has stepped end 90, having a diameter smaller than the housing 50. A pair of 180 degree opposing connecting pins 91 protrude radially from the stepped end 90. Second part 54 has a cylindrical end 92, having a bore 93 which engages the stepped end 90. A pair of L-shaped connecting slots 94 are formed in the end 90.

Figure 12A:
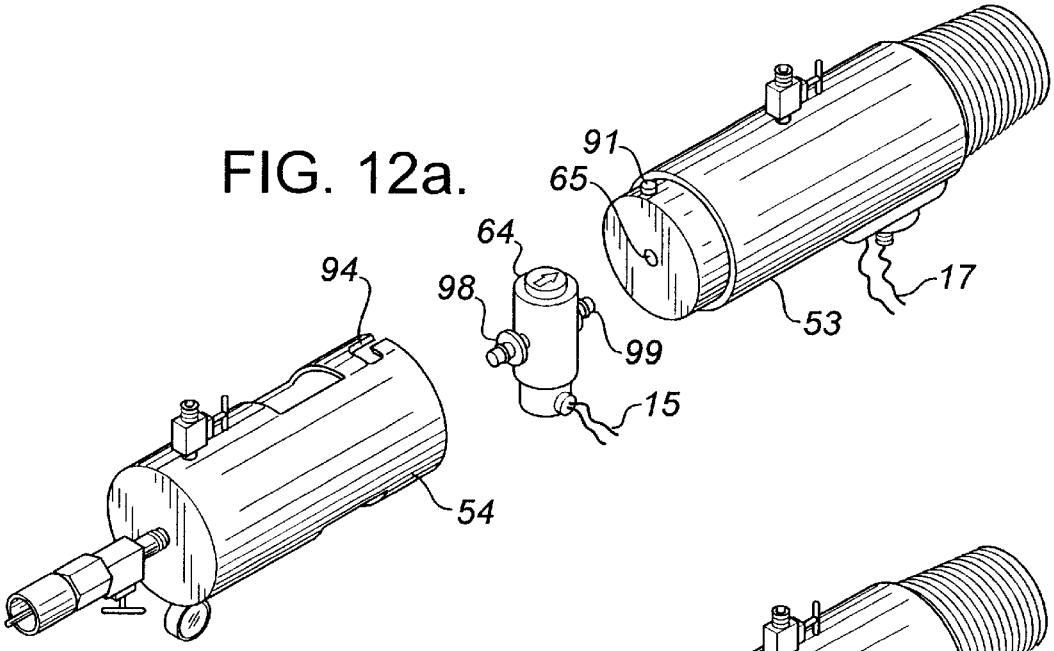
FIGS. 12*a*–12*c* illustrate the reversibly installable solenoid of FIG. 1. More specifically.
Figure 12B:
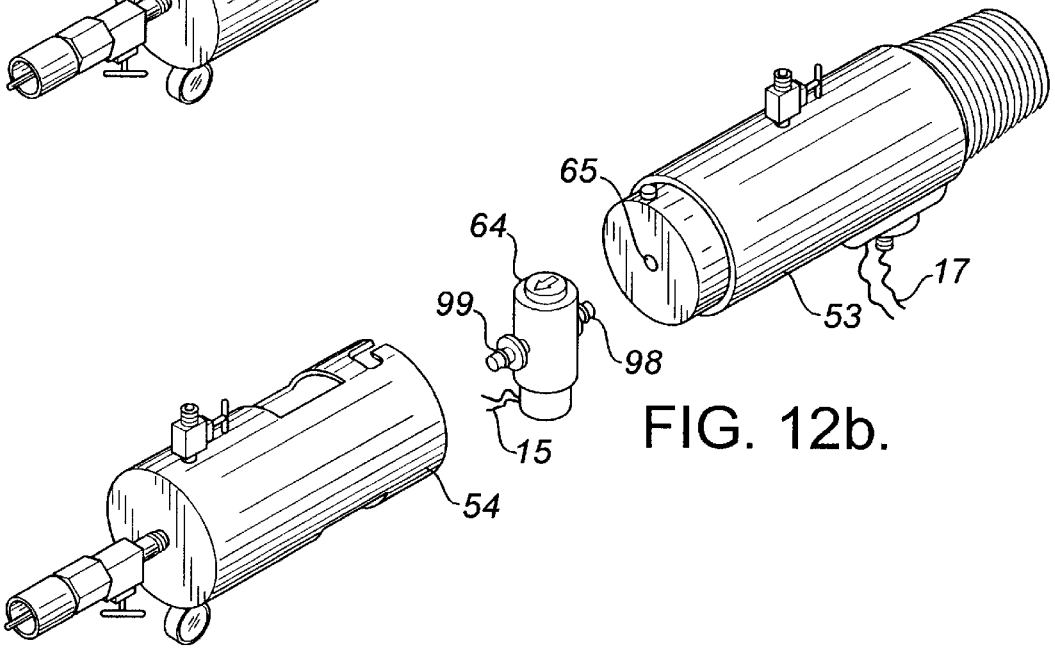
Figure 12C:
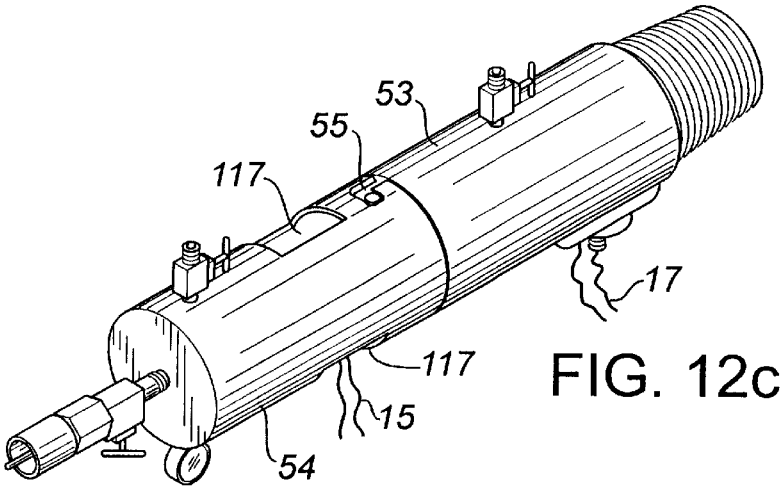

As illustrated in FIGS. 12*a*–12*c*, parts 53, 54 connect axially, pins 91 engaging slots 94. A circumferential twist locks the connection 55, preventing axial movement.

Chamber 51 forms first port 57, and second port 58 at its ends. The first port 57 is connected by conduit 59 to valve 60. Valve 60 is connected to the "Probe" portion 61 of a Plug and Probe valve assembly 35,61. A third port 62 connects the chamber 51 to a pressure gauge 63. A fourth port 95 is connected to bleed valve 96.

Figure 10:
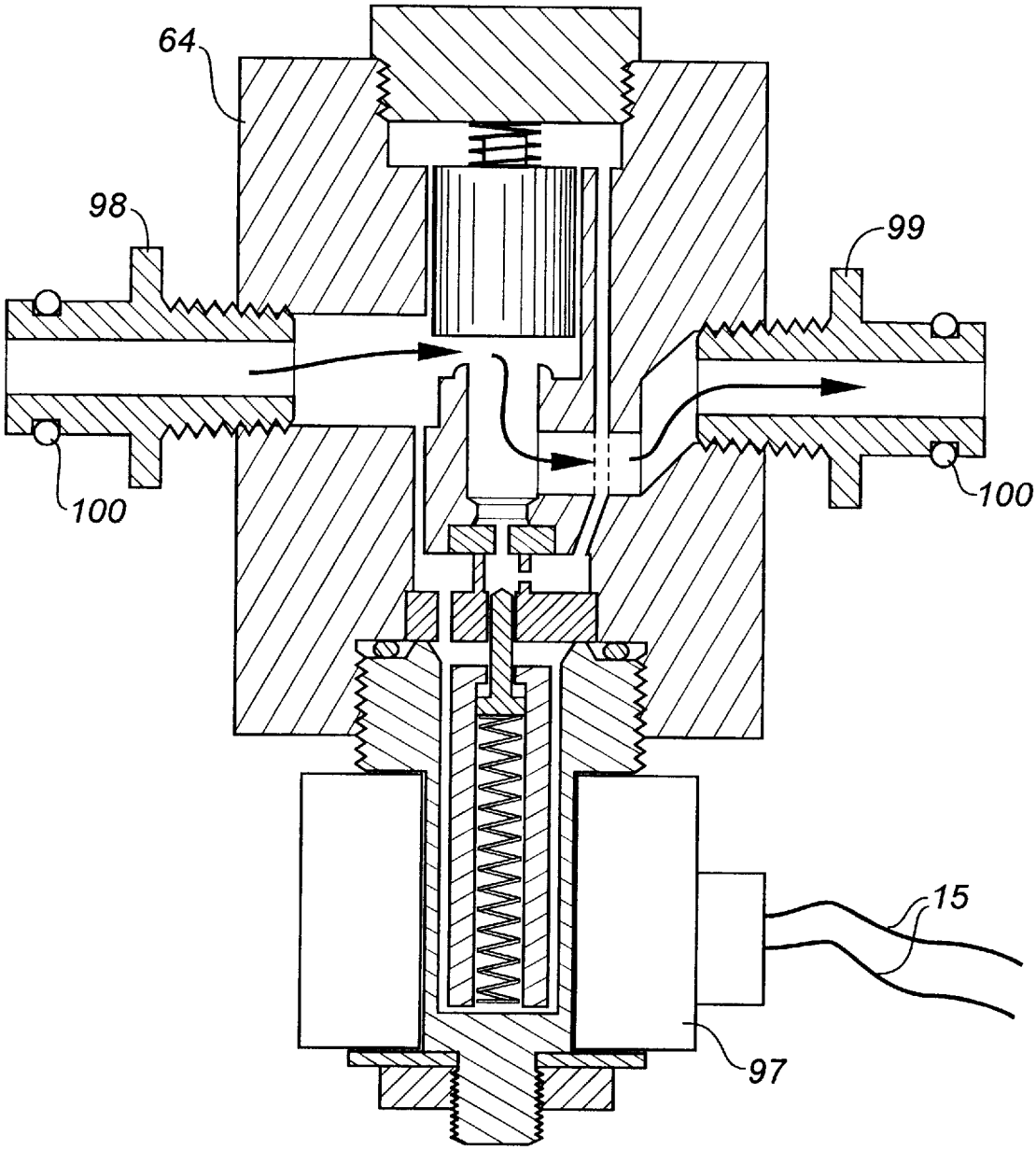
FIG. 10 is a cross-sectional view of the pilot-operated solenoid valve shown in FIG. 9.
Figure 11:
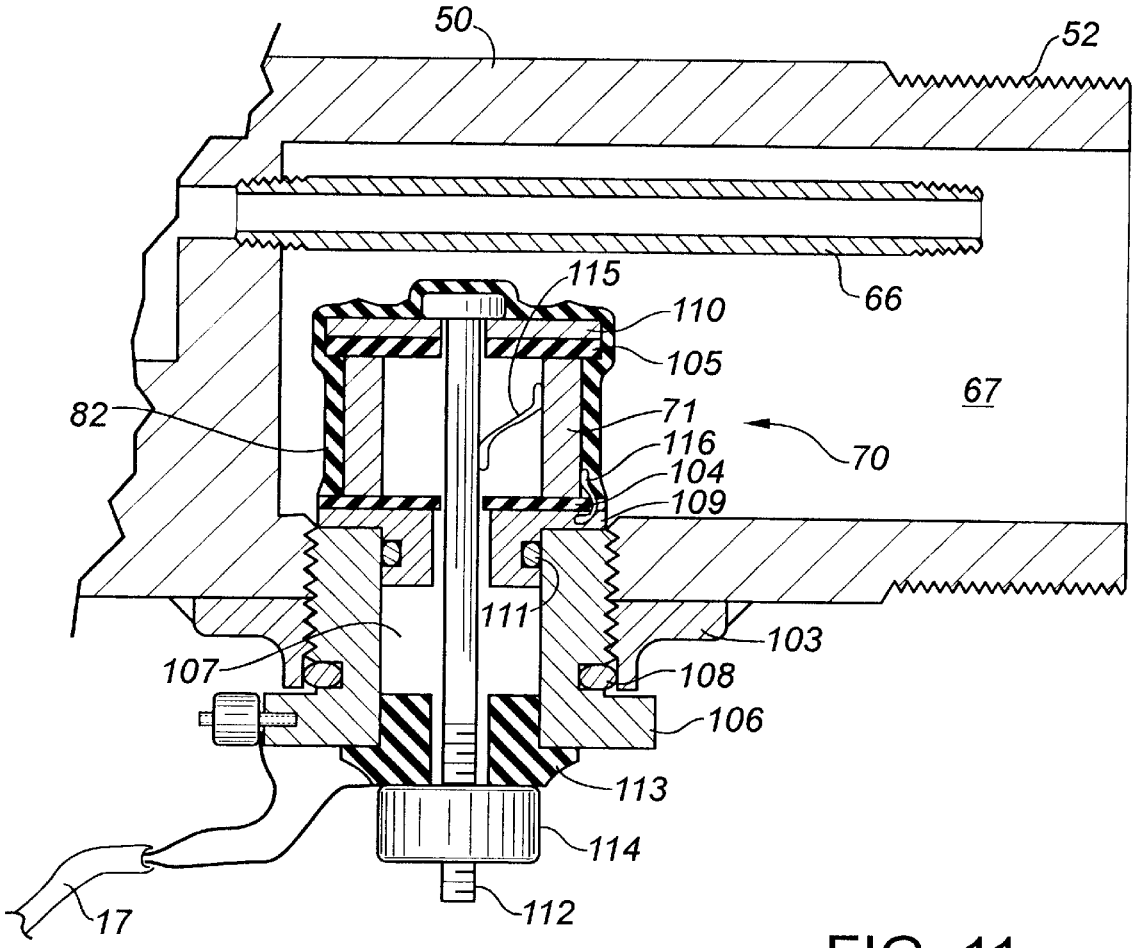
FIG. 11 is a partial, cross-sectional view of the wellhead connection end of the delivery assembly, in particular, showing the microphone assembly.

The second port 58 communicates with solenoid valve 64, available from Honeywell Inc., an example of which is described above. The solenoid valve 64, shown complete with electrical actuation coil 97, fits within bore 93. The solenoid valve 64 communicates with an output passageway 65 leading to conduit 66 which terminates within the bore 67 of the open end 52 of the housing 50. As shown in FIG. 10, solenoid valve 64 has flow conduits 98 and 99. As described above, gas flow through the solenoid valve 64 is unidirectional, determined by differential pressure across the valve. As shown in FIG. 10, gas flows from conduit 98 to conduit 99. Each conduit 98,99 is fitted with an O-ring seal 100 for sealing connection with outlet port 58 and outlet passageway 65. It is essential that conduit 98 or 99 fit and seal equally well in either port 58 or passageway 65, enabling installation of the solenoid in either of two orientations, thus permitting gas flow from the wellhead 3 or to the wellhead. A fifth port 101 is connected to bleed valve 102.

Microphone 70 is inserted though port 103 to reside within bore 67. Having reference to FIG. 10, the microphone is shown to comprise a 1" diameter, 1" high thin-wall hollow cylindrical piezoelectric crystal 71, as described earlier. One electrode 72 is connected on the inner cylindrical surface and one electrode 73 on the outer surface. The crystal 71 is sandwiched between two non-conductive acetal plastic washers 104,105.

Plug 106, having bore 107, is threaded into port 103. O-ring 108 sealing bore 67 from the atmosphere. Microphone 70 and washers 104,105 are in turn sandwiched between two stainless steel washers 109, 110. An O-ring 111 between washer 109 and plug 106 seals the bore 67 from the bore 107 of the plug 106. The crystal 71 and washers are encapsulated in the protective polyester resin 82 described previously.

The microphone assembly including, crystal 71, plastic washers 104, 105, and steel washers 109, 110 are secured to the plug 106 by a threaded rod 112. Rod 112 is secured to steel washer 110 and extends through bore 107, and through an acetal plastic washer 113 to a knurled nut 114. Upon tightening nut 114, the microphone assembly is held securely to the plug 106 and within the bore 67. Inner electrode 72 is connected by lead 115 to rod 112. Outer electrode 73 is grounded by lead 116 to plug 106, thus ultimately to the housing 50 and the wellhead 3. Plastic washer 114 isolates rod 113 from plug 106. Electrical lead 17 permits connection to control means 16.

Having reference to FIGS. 12*a*, 12*b* and 12*c* the second embodiment operates as follows. First, the desired direction of the release of high pressure gas is determined. For a release of high pressure gas from the gas gun 13 into a low pressure wellhead opening 6, the solenoid valve 64 is installed as shown in FIG. 12*a*. In FIG. 12*a*, the solenoid valve is marked by an arrow to show its direction of flow. Solenoid conduit 98 is inserted into outlet port 58 and conduit 99 is inserted into outlet passageway 65. As shown in FIG. 12*c*, the two housing parts 53 and 54 are assembled at connection 55. Solenoid valve 64 is immovably sandwiched between the two parts 53,54. Lead 15 protrude through access port 117.

For a release of high pressure gas from the wellhead 3 into gas gun chamber 51, the solenoid valve 64 is installed as shown in FIG. 12*b*. Conduit 98 is inserted into outlet passageway 65, and conduit 99 is inserted into outlet port 58. The two housing parts 53 and 54 are assembled.

The volume of chamber 51 may be enhanced as necessary by installing the hand held gas source 12 to first port 57 of the gas gun and opening valve 60.

Again, as described above, the solenoid 64 is then actuated by the control means 16 through lead 15, signalling for release of high pressure gas. Due to the setback location of microphone 70, the rush of gas passing through conduit 66 does not impinge on the microphone and thereby avoids overstressing it.

A combination of the automatic triggering of the pilot-operated solenoid valve gas gun and provision of a constant gas source results in a rapid and dependable automatic acoustic pulse, capable of frequent and repeated testing, without operator intervention. Adding the ability to reverse the direction of flow of gas, whilst retaining the capability for its rapid release, enables a greater variety of wells to be successfully and effectively tested.

The embodiments of the invention in which an exclusive property or privilege is claimed are defined as follows:

1. A improved gas gun for delivering an acoustic pulse and monitoring the resultant reflections from the annulus of a well, the well having a wellhead and a connection port enabling access to the annulus, comprising:

a housing having a sidewall forming a chamber and an open end for connecting to the wellhead;

said housing forming first port means at one end for providing access to the chamber, and second port means at the other end for providing access to the chamber from the housing open end;

means for connecting the second port means to the wellhead;

valve means on said first port means for blocking discharge of gas therefrom;

pilot-operated solenoid valve means positioned intermediate between the chamber and the second port means, said solenoid having an inlet port and an outlet port and being rapidly operable between open and closed positions substantially irrespective of the magnitude of pressure differential across it, the closed position for preventing the passage of gas through said outlet port, and the open position for enabling the passage of gas through said outlet port, wherein opening of the solenoid valve results in the sharp release of pressuring gas from the inlet to the outlet port;

means for alternately and sealably connecting the solenoid valve's inlet port to either the chamber or the second port means and correspondingly sealably connecting the solenoid valve's outlet port to the second port means or the chamber respectively; and microphone means positioned in the housing open end for receiving well annulus acoustic reflections.

2. The improved gas gun as recited in claim 1 wherein the open end comprises tubular conduit for connection to the well head and a the outlet port comprises a smaller conduit extending out into the open end.

3. The improved gas gun as recited in claim 2 wherein the microphone comprises:

a cylindrical piezoelectric ceramic crystal having one pole electrically insulated from ground and having a bore which is sealed from the well annulus so as to be substantially at atmospheric pressure, the outer surface being subjected to annular reflections wherein said microphone is located concentrically about the outlet port conduit.

4. The improved gas gun as recited in claim 2 wherein the microphone comprises:

a cylindrical piezoelectric ceramic crystal having one pole electrically insulated from ground and having a bore which is sealed from the well annulus so as to be substantially at atmospheric pressure, the outer surface being subjected to annular reflections wherein said microphone is set further back in the housing than is the end of the outlet port conduit.

5. The improved gas gun as recited in claim 2 comprising:

means for introducing pressurized gas to the first port means wherein the solenoid valve inlet port is connected to the chamber and the outlet port is connected to the second port means so that opening of the solenoid valve results in the sharp release of gas from the chamber and into the well's annulus.

6. The improved gas gun as recited in claim 2 wherein the solenoid valve inlet port is connected to the second port means and the outlet port is connected to the chamber so that opening of the solenoid valve results in the sharp release of gas from the well's annulus into the chamber.

7. The improved gas gun as recited in claim 5 wherein the means for introducing pressurized gas to the inlet port comprises:

a hand-held gas source comprising a two-part housing assembly comprising first and second aligned parts, the parts combining to form a substantially cylindrical chamber for reception of a disposable cylindrical pressurized $CO_2$ cartridge, telescoping means for physically connecting the two housing parts and sealing therebetween, the first housing part having a closed end for advancing the cartridge into the chamber portion formed by the second housing part, means, positioned in the chamber of the second housing part for piercing the cartridge and releasing pressurized $CO_2$ gas into the chamber, outlet port means at one end of the housing for discharging gas from the chamber; and valve means positioned in the outlet port means for controlling the release of pressurized $CO_2$ from the chamber to the inlet port means of the gas gun housing.

8. In a gas gun of a well annulus, said gas gun having a gas storage chamber, an inlet port for accepting pressurized gas, and a valve for controlling the supply of the gas from the gas storage chamber to the well annulus to generate an acoustic pulse, the improvement comprising:

a hand-held gas source comprising:

a disposable hand-held cylindrical pressurized $CO_2$ gas cartridge;

a hand-held two-part assembly comprising first and second cylindrical and aligned parts, each of said parts comprising a hollow cylinder having one closed end and one open end;

means for connecting and sealing said cylindrical parts at said open ends to form a gas source chamber for reception of said cartridge;

outlet port means at one end of said gas source chamber for discharging $CO_2$ gas from said gas source chamber, said outlet port means having a hand-operated attachment for connection with the inlet port of the gas gun;

means for piercing said cartridge, said piercing means being positioned within said gas source chamber at said closed end of one of said parts;

means for telescoping said cylindrical parts together to advance said closed ends of said cylindrical parts towards each other and advance said $CO_2$ gas cartridge towards said piercing means to pierce said cartridge and release pressurized $CO_2$ gas into said gas source chamber; and valve means positioned in said outlet port means for controlling the release of the pressurized $CO_2$ gas from said gas source chamber into the gas storage chamber.

9. The improved gas gun according to claim 8, said hand-held gas source further comprising:

a first one of said parts being provided with a base spaced from a first open end of said one of said parts;

external threads being provided on said first part extending away from said first open end to said base;

an O-ring at said base of said first part;

a second one of said parts being provided with internal threads inset from a second open end of said second one of said parts, a thread-free O-ring sealing surface extending on said second part from said second open end to said internal threads;

said internal and external threads being engaged to effect said connecting of said cylindrical parts so that with said threads engaged said thread-free sealing surface is positioned opposite to said O-ring to effect said sealing; and said thread-free sealing surface having a length from said second open end sufficient to continue to contact said O-ring and effect said sealing as said first and second parts are telescoped and said gas cartridge is pierced by said piercing means.

* * * * *